US007509914B2

(12) United States Patent
Murphy

(10) Patent No.: US 7,509,914 B2
(45) Date of Patent: Mar. 31, 2009

(54) FOLDING LEG APPARATUS

(75) Inventor: Michael L. Murphy, Owensboro, KY (US)

(73) Assignee: Ditto Sales, Inc., Jasper, IN (US)

( * ) Notice: Subject to any disclaimer, the term of this patent is extended or adjusted under 35 U.S.C. 154(b) by 431 days.

(21) Appl. No.: 11/369,393

(22) Filed: Mar. 7, 2006

(65) Prior Publication Data

US 2007/0210637 A1 Sep. 13, 2007

(51) Int. Cl.
*A47B 3/00* (2006.01)

(52) U.S. Cl. ..... 108/133; 108/132; 108/127

(58) Field of Classification Search ..... 297/16.1; 108/131–133, 129, 127, 150, 121, 115; 248/188, 248/188.6, 439, 440

See application file for complete search history.

(56) References Cited

U.S. PATENT DOCUMENTS 2,355,929 A * 8/1944 Tave ..... 248/188.6
4,838,180 A 6/1989 Gutgsell
5,279,233 A * 1/1994 Cox ..... 108/129
5,390,610 A 2/1995 Gutgsell
5,528,997 A 6/1996 Miller
5,673,633 A 10/1997 Pfister
5,913,272 A 6/1999 Gutgsell et al.
5,941,181 A 8/1999 Hornberger et al.

* cited by examiner

*Primary Examiner*—Milton Nelson, Jr.
(74) *Attorney, Agent, or Firm*—Maginot, Moore & Beck LLP

(57) ABSTRACT

A folding leg apparatus for an article of furniture having a top and a support leg movable between an extended and a folded position comprises a mounting plate configured for attachment to the top of the article of furniture and including a pair of mounting flanges extending along opposite sides of the mounting plate, an upper pivot rod attached to the support leg adjacent the top end, a first pivoting connection between each end of the upper pivot rod and a corresponding one of the pair of mounting flanges and a second pivoting connection between the support leg and a corresponding one of the pair of mounting flanges offset on the support leg from the upper pivot rod. A latch mechanism is provided that includes a pair of pivot arms, each pivotably mounted to a corresponding one of the pair of mounting flanges and positioned between the flanges. Each of the pivot arms includes an actuator plate positioned between the flanges and adapted to be manually pressed. The actuator plates are space apart to receive the support leg passing therethrough. Each of the pivot arms further defines a locking notch configured to capture the upper pivot rod therein when the support leg is in its extended position and the pivot arms are in a locking position. A pair of torsion springs are each operatively anchored to a corresponding one of the pivot arms to bias the pivot arms to the locking position and operable to resist rotation of the pivot arms when the corresponding actuator plate is manually pressed, each of the torsion springs positioned between the mounting flanges.

12 Claims, 3 Drawing Sheets

FOLDING LEG APPARATUS

BACKGROUND OF THE INVENTION

The present invention pertains generally to folding furniture and, more specifically to tables having legs that fold compactly underneath the tabletop. In particular, the invention concerns a folding apparatus for extending-and retracting the legs.

Folding tables are widely used and derive their primary benefit from the relative ease with which they can be handled and stored when in the folded condition. One typical folding table leg is described in the patent to Weagle, U.S. Pat. No. 3,695,567. Folding tables of this type do not include a cross brace that provides fore and aft support for the table leg. An alternative design is a trestle-type table, such as the folding table shown in the patents to Burr, U.S. Pat. Nos. 3,818,844 and 4,444,124. In these tables, the vertical legs do not overlap each other; however, like the Weagle device, the folded legs themselves provide the stacking surface for other folded tables.

U.S. Pat. No. 4,838,180, owned by the assignee of this invention, describes a folding table that allows the table legs to be compactly folded underneath the tabletop, while still providing a uniform surface on which other tables may be stacked. One benefit of the folding table leg apparatus shown in the '180 patent is that the stacked tables are not supported on the folded legs, but rather on upright flanges forming part of the folding leg apparatus.

Certain details of the folding table leg apparatus of the '180 patent are depicted in FIG. 1. As shown in this figure, the folding leg apparatus 10 includes a top plate 11 that is mounted to the underside of a tabletop. The top plate 11 includes opposite side flanges 12 that project perpendicularly outward from the top plate 11. The side flanges provide a surface for stacking a folded table. The folding leg apparatus 10 of this prior device includes a tubular vertical leg 15 that terminates in a base or foot that is configured to support the table on the floor. A pair of support brackets 20 are each mounted to the top plate 11 at opposite sides of the vertical leg 15. The support brackets provide an attachment or pivot point for a pair of brace links 22. The brace links 22 are pivotably connected at one end to the support bracket 20 and at the other end to the vertical leg 15 by way of a lower pivot rod 24 that passes through the tubular leg. The vertical leg 15 is also supported by an upper pivot rod 26 that spans substantially across the width of the top plate 11 and is offset from the lower pivot rod along the length of the leg. The upper pivot rod 26 is pivotably connected to the side flanges 12 by way of opposite swivel brackets 28. Thus, the brace links 22 and swivel brackets 28 provide a mechanical linkage for controlled movement of the vertical leg 15 between its folded and its extended positions.

In a further aspect of this prior apparatus, a pair of release brackets 30 is provided for positively locking the upper pivot rod 26 in place when the vertical leg 15 is in its extended position. Each of the release brackets includes a lever arm 32 and an actuator plate 34 that is manually depressed to release the upper pivot rod. The actuator plates 34 are flared outward from the support brackets 20 so as not to interfere with the movement of the table leg 15 as it is pivoted between its folded and extended positions. A torsion spring 36 pivotably mounted on the outside of each support bracket 20 provides a positive torque to each lever arm 32 to keep it in its locked position when the release brackets 30 are engaged to the upper pivot rod 26. In this manner, the folding leg apparatus 10 of the '180 patent provides a positive locking mechanism to hold the vertical leg in its extended position. Likewise, the release brackets 30 provide an easy way to release the upper pivot rod so that the vertical leg can be rotated and pivoted to its stowed position. Greater detail concerning the folding leg apparatus 10 of this prior device can be found in the specification of the '180 patent, which description is incorporated herein by reference.

Details of another folding leg apparatus 40, shown in FIG. 2, are described in U.S. Pat. No. 5,913,272, the disclosure of which is incorporated herein by reference. In particular, the apparatus 40 includes a pair of opposite support brackets 42. Each of the support brackets 42 is defined by a mounting plate 41 and an integral mounting flange 50. Each of the mounting plates 41 includes a number of openings to receive a fastener for engaging the folding leg apparatus 40 to the underside of a tabletop.

The folding leg apparatus 40 includes a lifting handle 48 that is welded to each of the support brackets 42. The lifting handle 48 is provided for two purposes: first, to provide a hand hold to lift the table with the legs in their folded position; and second, to provide a surface for supporting the weight of another folded table stacked on top of the particular table to which the folding leg apparatus 40 is attached.

The folding leg apparatus 40 includes an upper pivot rod 56 that is secured to the table leg 45. In the '272 Patent, the table leg 45 is shown as including a pair of vertical bars that form each leg of the table. The upper pivot rod 56 is connected at its ends to opposite swivel brackets 58 by way of pivot screws. The connection between the upper pivot rod 56 and swivel bracket 58 is such that the rod can rotate relative to the bracket as the bracket itself is pivoted to extend or retract the table leg 45. The swivel bracket 58 is engaged to the upper pivot rod 56 at one end and is connected by way of a pivoting rivet at its opposite end to the mounting flanges 50 of the opposite support brackets 42. Thus, the swivel bracket 58 is permitted to pivot relative to the support bracket to manipulate the table leg. The swivel bracket 58 preferably includes a bend 58*a* adjacent the pivoting rivet so that the bracket can be connected to the upper pivot rod 68 outside the envelope of the support brackets 42.

The folding leg apparatus 40 also includes a lower pivot rod 54 that is engaged to the table leg 45 at a position offset along the length of the leg from the upper pivot rod. The lower pivot rod 54 is pivotably connected to the flange 50 of each support bracket 42 by way of a brace link 52. Specifically, the lower pivot rod 54 is attached to one end of each brace link 52 by way of a pivot screw so that the rod can rotate relative to the brace link. The brace link 52 itself is pivotably fixed to the mounting flanges 50 by way of a pivoting rivet, in a manner similar to the swivel bracket 58.

Each brace link 52 includes a pair of bends 52*a* and 52*b*, one bend being adjacent the rivet or mounting flange 50 and the other being adjacent the pivot screw or table leg 45. These bends are arranged to orient the connection to the lower pivot rod as close to the table leg 45 as possible. The narrow track of the brace links 52 and the wide track of the swivel brackets 58 help stabilize the table leg 45 when it is in its extended position.

The folding leg apparatus 40 of the '272 Patent includes a release lever 60 that is configured differently from the release brackets of the device in the '180 patent. The release lever includes an elongated actuator plate 64 that merges at its ends into lever arms 62. Each of the lever arms 62 defines a locking notch 63 that is formed to receive the upper pivot rod 56 therein. The release lever 60 is arranged so that the actuator plate 64 is disposed between the pivot point for the brace links 52 and the table leg 45. The release lever 60 is pivotably supported on the mounting flanges 50 of each of the support brackets 42 by way of a bolt 68. The bolt 68 is fastened to the release lever 60 by passage of the bolt 68 through the keyed openings in each of the lever arms 62, and is held in place by a nut.

The head of each bolt 68 also defines an enlarged spring slot that is configured to engage a portion of a torsion spring 66. In accordance with the invention, each bolt 68 extends through an opening in the mounting flanges 50 of each of the support brackets 42. The torsion spring 66 then passes over the head of the bolt so that an anchor arm of the torsion spring resides within the spring slot. The torsion spring 66 also includes a spring anchor 67 that is in the shape of a U to engage the upper edge of each of the mounting flanges 50. Thus, the spring 66 operates to provide torsional resistance against rotation of the bolt 68 relative to the mounting flange 50, which translates ultimately into torsional resistance against rotation of the release lever 60.

It can be noted that the actuator plate 64 is disposed within the envelope of the folding mechanism, and particularly between the support flanges 50. Thus, when it is desired to fold the table leg 40 to its stored position, the actuator plate 64 is depressed so that as the actuator plate 64 is pushed downward, the release lever 60 operates against the action of each torsion spring 66. As the release lever 60 continues to pivot about the axis of the pivot bolt 68 the locking notch 63 disengages from the upper pivot rod 56. The table leg 45 can then be moved to its stowed position by pushing the foot of the table leg toward the release lever 60. This action causes the free end of the table leg to swing outward thereby pivoting the swivel brackets 58 in a clockwise direction. Continued movement of the foot of the table leg 45 towards the release lever 60 causes the swivel brackets 58 to continue to pivot in a clockwise fashion, and to cause the brace links 52 to pivot in a clockwise direction. At this orientation, the table leg is generally parallel to the mounting plates 41 of the folding leg apparatus 40 and within the envelope defined by the lifting handles 58. Thus, additional tables can be stacked on the folding leg apparatus 60 without contacting the table legs themselves.

One benefit of the folding leg apparatus 40 described in the '272 Patent is that the release lever 60 is contained with the envelope of the apparatus 40 so that it is unlikely to be inadvertently contacted by a person sitting at the table. The release plates 34 of the apparatus 10 shown in the '610 Patent fall outside the support brackets 20 so they may be accidentally contacted and depressed by the foot of a person sitting at the table. However, one detriment common to the folding table leg apparatuses 10 and 40 is that the torsion springs, 36 and 66, respectively, are situated outside the support brackets and are therefore at risk of being contacted by a person at the table. This risk is mitigated somewhat in the apparatus 10 because the swivel brackets 28 are situated outboard of the torsion springs; however, the swivel brackets are then at risk of being contacted by the person.

There is a need for a folding table leg apparatus that incorporates the beneficial aspects of the apparatuses 10 and 40 disclosed in the '610 and '272 Patents, without the associated disadvantages. There is a further need for a folding table leg apparatus that is compact in size so that it can be used on differently sized tables and so that the overall envelope of the apparatus is minimal. There is an additional need for a folding table leg apparatus that can be easily released without the risk of the operator being pinched by the moving components of the apparatus.

SUMMARY OF THE INVENTION

These needs are met by a folding table leg apparatus provided for an article of furniture having a top and a support leg movable between an extended and a folded position. The support leg has a top end adjacent the furniture top in the extended position and a bottom end configured to support the article of furniture on a surface. In accordance with the invention, the folding leg apparatus comprises a mounting plate configured for attachment to the top of the article of furniture which includes a pair of mounting flanges extending along opposite sides of the mounting plate. In one aspect, the mounting plate is a one-piece U-shaped plate.

A folding mechanism includes an upper pivot rod attached to the support leg adjacent the top end and a first pivoting connection between each end of the upper pivot rod and a corresponding one of the pair of mounting flanges. The mechanism further includes a second pivoting connection between the support leg and a corresponding one of the pair of mounting flanges offset on the support leg from the upper pivot rod. Preferably, this second pivoting mechanism includes a lower pivot rod attached to the support leg at a position offset from the upper pivot rod.

In one feature of the invention, the apparatus further comprises a latch mechanism that includes a pair of pivot arms, each pivotably mounted to a corresponding one of the pair of mounting flanges and positioned between the flanges. Each of the pivot arms includes an actuator plate positioned between the flanges that is adapted to be manually pressed. Each of the pivot arms further define a locking notch that is configured to capture and lock the upper pivot rod therein when the support leg is in its extended position and the pivot arms are in a locking position. A pair of torsion springs are each operatively anchored to a corresponding one of the pivot arms to bias the pivot arms to the locking position and to resist rotation of the pivot arms when the corresponding actuator plate is manually pressed. In accordance with one feature of the invention, each of the torsion springs is positioned between the mounting flanges.

In certain embodiments, the first pivoting connection includes a pair of swivel brackets, each connected at one end thereof to a corresponding end of the upper pivot rod to pivot relative to the support leg, and pivotably connected at an opposite end thereof to a corresponding one of the pair of mounting flanges. In one aspect, the pair of swivel brackets are positioned between the pair of mounting flanges. The second pivoting connection includes a lower pivot rod attached to the support leg offset from the upper pivot rod and a pair of brace links. Each of the brace links is connected at one end thereof to a corresponding end of the lower pivot rod to pivot relative to the support leg, and pivotably connected at an opposite end thereof to a corresponding one of the pair of mounting flanges. The pair of brace links are preferably positioned outside the pair of mounting flanges.

In accordance with one aspect of the invention, the actuator plates define a space between each other that is sized to receive the support leg therebetween when the leg is in the folded position, Thus, the actuator plates are disposed within the envelop of the mounting plate and protected from inadvertent actuation. At the same time, the space between the actuator plates allows the top end of the support leg to pivot through the space as it is moved between its extended and folded positions.

It is one object of the invention to provide a folding leg apparatus that is compact and adapted to be readily mounted to a wide range of articles of furniture and tables. Another object is to provide a folding mechanism that is protected against inadvertent contact and actuation by a person seated at the table.

One benefit of the invention is that the majority of the working components of the folding mechanism are protected from inadvertent contact. A further benefit is that the folding apparatus of the invention occupies a small envelop so that it can be used in a wide range of applications. Other objects and benefits of the invention will become apparent upon consideration of the following written description and the accompanying figures.

DESCRIPTION OF THE PREFERRED EMBODIMENTS

Figure 1:
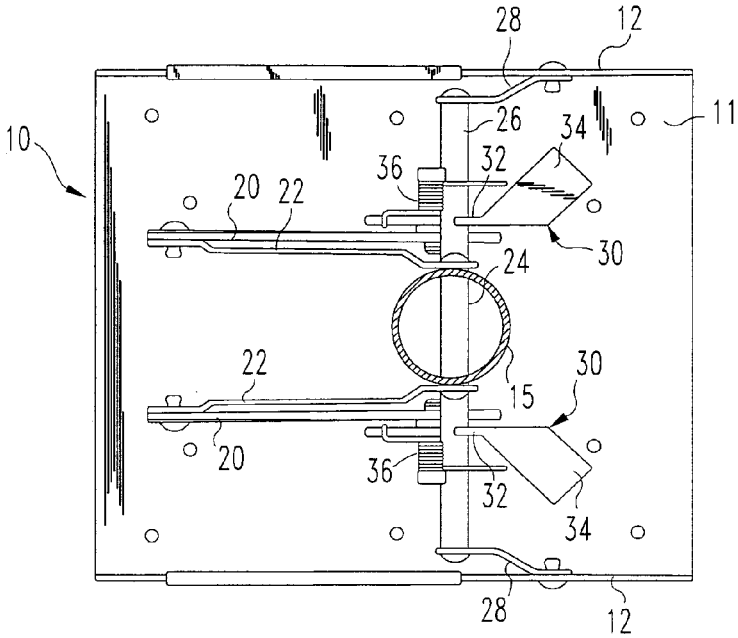
Fig. 1 (PRIOR ART)
FIG. 1 is a top elevational view of a folding table leg apparatus as described U.S. Pat. No. 4,838,180.

For the purposes of promoting an understanding of the principles of the invention, reference will now be made to one preferred embodiment illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

Figure 3:
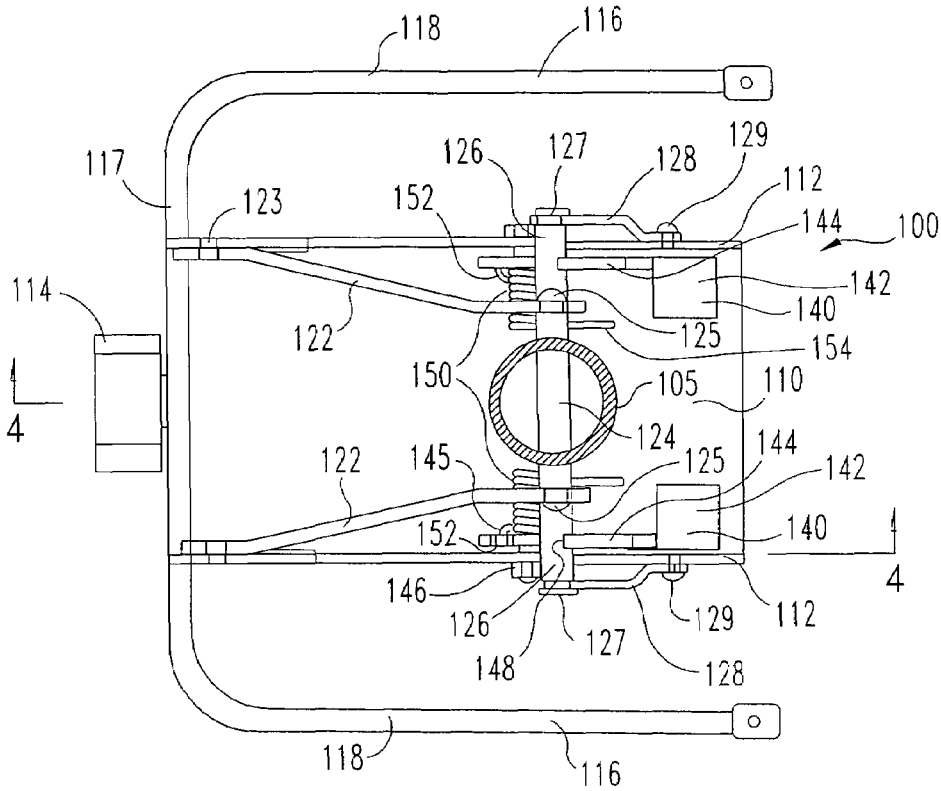
FIG. 3 is a top elevational view of a folding table leg apparatus in accordance with one embodiment of the present invention, with the table leg in its extended and locked orientation.
Figure 4:
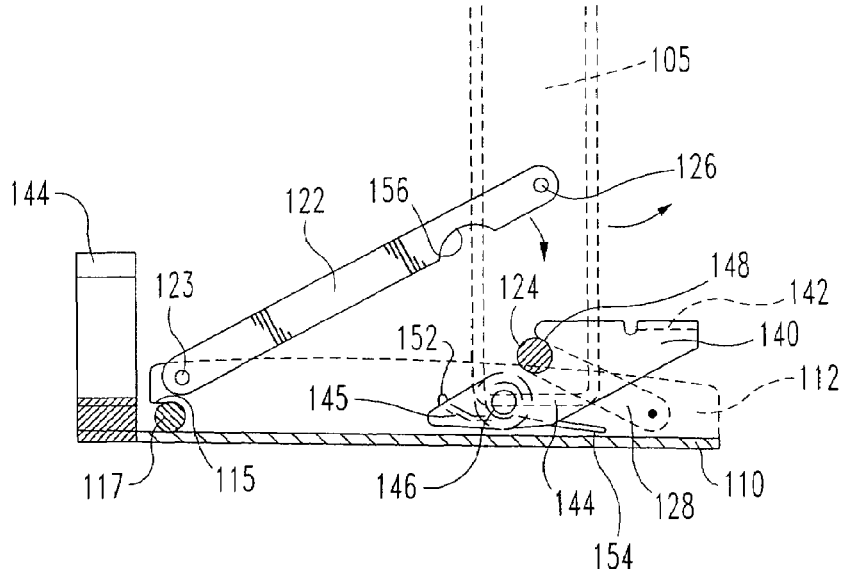
FIG. 4 is a side partial cross-sectional view of the apparatus shown in FIG. 3, taken along line 4-4 as viewed in the direction of the arrows.
Figure 5:
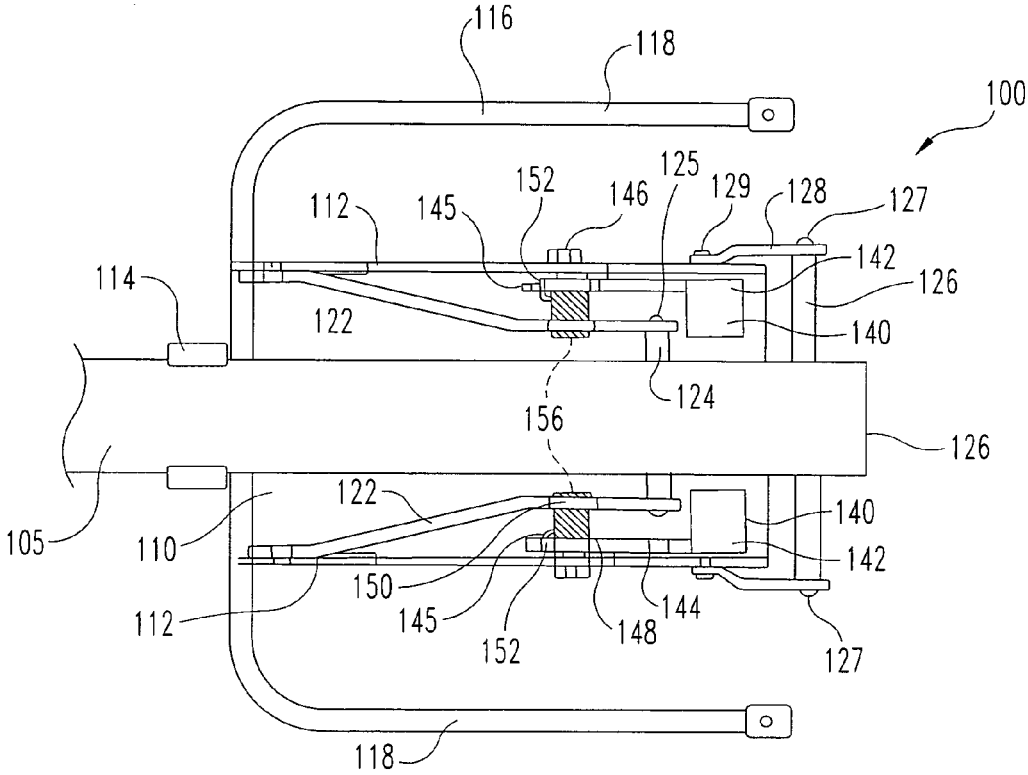
FIG. 5 is a top elevational view of the folding table leg apparatus shown in FIG. 3, with the table leg in its retracted or stowed position.

A folding table leg apparatus 100 in accordance with one embodiment of the present invention is illustrated in FIGS. 3-5. The apparatus 100 supports a table leg 105 in an extended position, as shown in FIGS. 3-4, and in a retracted or stowed position, as depicted in FIG. 5. The apparatus 100 includes a mounting plate 110 with mounting flanges 112 at the opposite side edges of the plate. In accordance with the preferred embodiment, the flanges 112 are formed by upturning the sides of the plate 110 to form a U-shaped one-piece body. The plate may be provided with screw holes to provide means for mounting the plate 100 to the underside of a table top in a conventional manner.

A retainer clip 114 of known construction is preferably attached to one end of the mounting plate 110. The clip is configured to grasp and retain the body of the table leg 105 in its folded position, as illustrated in FIG. 5.

The apparatus further includes a lifting handle 116 that is preferably similar in configuration to the lifting handle shown in the '272 Patent. In accordance with the illustrated embodiment, the lifting handle includes a center bar 117 that is fixed within notches 115 at one end of each of the mounting flanges 112. Preferably the center bar is welded to the flanges at each notch. The arms 118 of the lifting handle 116 are bent so that the arms extend beyond the envelope of the mounting plate and the table leg 105 when the leg is in its folded position. The ends of each arm may be provided with screw holes for fastening the arms to the table top. As described in the '272 Patent, the lifting handle 116 not only works as a handle for lifting and carrying the table, it also serves as a support surface for stacking folded tables on top of each other.

The folding mechanism for the apparatus 100 includes pivoting connections between the table leg and the opposite mounting flanges 112. In the preferred embodiment, the pivoting connections include a lower pivot rod 124 and an upper pivot rod 126 that each pass through the diameter of the leg 105. The lower pivot rod 124 is offset along the longitudinal axis of the leg 105 relative to the upper pivot rod 126, as best seen in FIG. 5. These pivot rods are preferably attached to the table leg, such as by welding each rod passing through diametrically opposite holes in the table leg. Alternatively, the rods may be free to rotate within these holes or within bushings fitted within the lower and upper diametrically opposite holes.

The apparatus includes a brace link 122 that is pivotably mounted to each flange 112 at a pivot mount 123. The pivot mount 123 may be of any form that allows the brace link to rotate relative to the flange, such as a rivet or a nut and bolt arrangement. As shown in FIG. 3, the pivot mount 123 for each brace link is at the end of the mounting plate 110 adjacent the retainer clip 114. The opposite end of each brace link 122 is pivotably connected to an lower pivot rod 124 by way of a suitable pivot mount 125. The pivot mount 125 may again be of any form that allows the brace link to rotate relative to the rod 124, such as a screw that is threaded into a mating bore in each end of the rod 124. Alternatively, the opposite end of each brace link may be fixedly connected to the lower pivot rod 124, provided that the rod itself is free to rotate within the holes through the table leg, as described above.

The folding mechanism of the apparatus 100 includes swivel brackets 128 that are pivotably mounted to the flange 112 by a pivot mount 129. The pivot mount 129 preferably has the same construction as the pivot mount 123 used to pivotably fasten the brace link 122 to the flange. As shown in FIG. 3, the swivel brackets are connected to the opposite end of the mounting plate 110 from the brace link mount. The other end of each swivel bracket is connected to a corresponding end of the upper pivot rod 126 by way of another pivot mount 127. This pivot mount 127 may have the same construction as the pivot mount 125 used to connect the brace link to the lower pivot rod 124.

As is apparent from FIG. 5, the brace links 122 are longer than the swivel brackets 128. The brace links 122 are connected to the table leg 105 adjacent the upper end 106. Since this end of the leg does not need to move very far between the extended position shown in FIGS. 3-4 and the retracted position shown in FIG. 5, the swivel bracket only needs to be long enough so that the upper pivot rod 126 clears the end of the mounting flanges 112 when the leg is retracted. The brace link 122 necessarily is longer since it is connected to the table leg at a lower position on the leg to form a brace structure to stabilize the leg in its extended position, as seen in FIG. 4. It can be appreciated from this figure that the brace links 122 pivot through a smaller angle of rotation than the swivel brackets 128 when the table leg 105 is moved between the extended and retracted positions.

Figure 2:
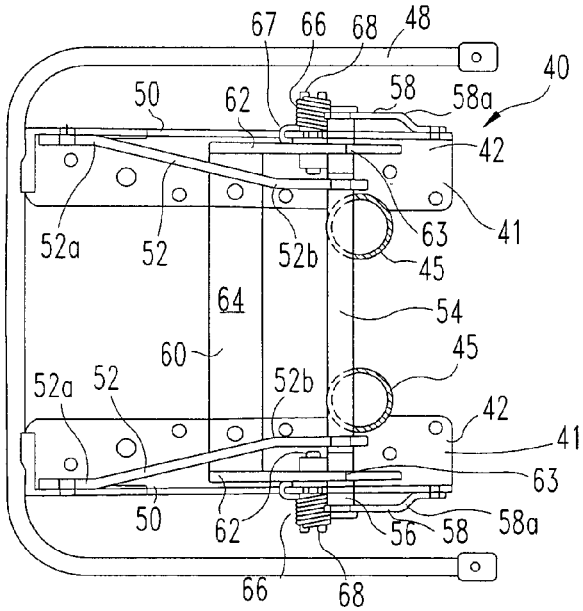
Fig. 2 (PRIOR ART)
FIG. 2 is a top elevational view of a folding table leg apparatus as described U.S. Pat. No. 5,913,272.

As thus far presented, the folding table leg apparatus 100 of the present invention is similar in construction and operation to the apparatus 40 disclosed in the '272 Patent and depicted in FIG. 2 herein. However, one significant difference is that the mounting plate 110 of the apparatus 100 of the present invention is a single piece component, versus the two plates 41 that make up the apparatus 40. Another difference is that the distance between the mounting flanges 112 that define the general envelope of the apparatus 100 is narrower than the distance between the flanges 50 of the apparatus of the '272 Patent. This reduced envelope provides several benefits absent in the prior folding leg apparatuses. For instance, the smaller profile allows the apparatus 100 of the present invention to be used on narrower tables. In addition, the compactness of the apparatus 100 places the folding mechanism farther out of reach of people seated at the table.

The compactness of the apparatus 100 of the present invention is further maintained by the locking and release mechanism that locks the table leg 105 in its extended position shown in FIGS. 3-4. As explained above, the prior apparatuses 10 and 40 shown in FIGS. 1-2 have significant portions of the locking and release mechanisms outside the mounting flanges. In the case of the apparatus 10 described in the '610 Patent, the actuator plates 34 and the torsion springs 36 are outside the mounting flanges 20. In the apparatus 40 described in the '272 Patent, the torsion springs 66 are outside the flanges 50. While the actuator plate 64 of the apparatus 40 is situated between the flanges, the spacing between the flanges must be sufficient to allow a person to guide their hand between the extended brace links 52 and still have sufficient purchase to depress the actuator plate 64. Thus, the actuator plate of the apparatus 40 necessarily increases the width of the apparatus in relation to the width of the mounting flanges 20 of the apparatus 10.

The present invention avoids these aspects of the two prior apparatuses 10 and 40. More specifically, the torsion springs 150 are mounted on the inside of the mounting flanges 112 entirely within the envelope of the mounting plate 110, as shown in FIGS. 3 and 5. In particular, a torsion spring 150 is concentrically mounted over each pivot mount 146 for the release levers 140. Thus, it can be appreciated that the pivot mounts project inwardly from the mounting flanges 112, as seen in FIGS. 3 and 5.

Figure 6:
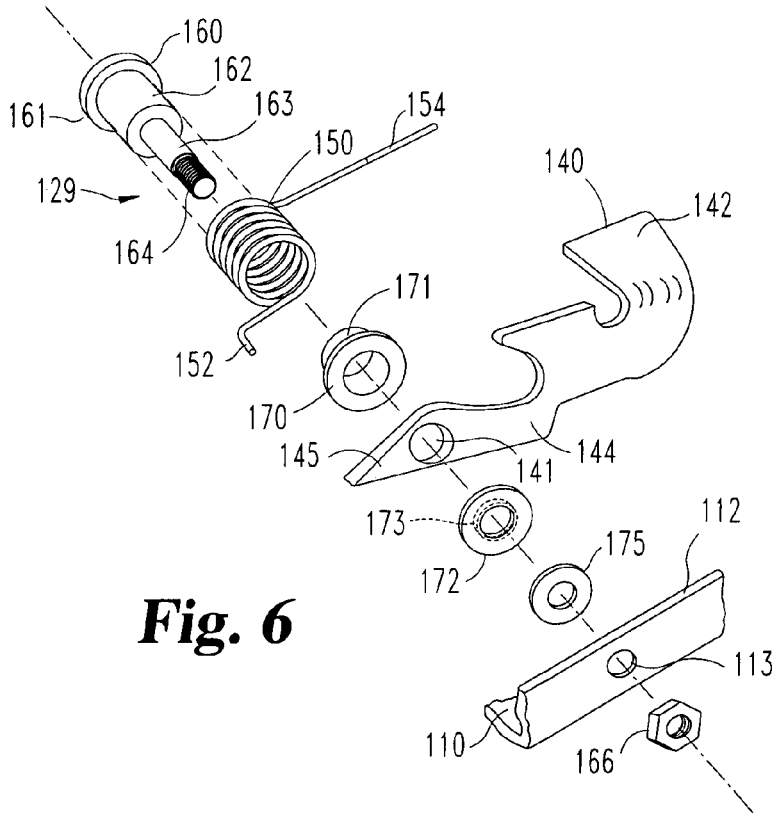
FIG. 6 is an exploded view of the components of the pivot mount of the apparatus shown in FIGS. 3-5.

Details of a pivot mount of the preferred embodiment are depicted in FIG. 6. In this embodiment, the mount 129 includes a carriage bolt 160 having a shank 162 sized to extend through and support part of the torsion spring 150. The carriage bolt includes a threaded end 164 that passes through the opening 113 in the mounting flange 112 to engage a nut 166 on the outside of the flange. The carriage bolt further includes an intermediate shank 163 that passes through the spring 150 and the opening 141 in the lever arm 144 of the release lever. The intermediate shank is sized to support a spring bushing 170 that includes a hub 171 that fits within the spring 150. The shank 163 also supports a lever bushing 172 that includes a hub 173 that fits within the opening 141 in the lever arm 144. A spacer 175 completes the stack and spaces the lever bushing 172 and the lever arm 144 from the inside of the mounting flange 112.

The torsion spring may be captured between the head 161 of the carriage bolt and the spring bushing 170. The bushing may be press-fit onto the intermediate shank 163. The shank 162 and the hub 171 of the spring bushing provide a bearing surface for the flexing of the coils of the torsion spring 150 when the release lever 140 is depressed and released. Similarly, the lever bushing 172 may be press-fit onto the intermediate shank 163 to capture the lever arm base 145 between the two bushings 170 and 172. It is important, however, that the lever arm 144 be free to rotate relative to the pivot mount 129, resisted only by the anchor 152 of the torsion spring 150. The lever arm base 145 limits rotation of the lever arm under influence of the torsion spring by contacting the plate 110, as illustrated in FIG. 4. This feature ensures that the lever arms 144, and particularly the locking notches 148 will always be in a position to engage the upper pivot rod 124 when the leg 105 is being moved from its folded position to its extended position.

Returning to FIGS. 3-5, it can be seen that the torsion spring 150 has one end that engages the release lever 140, namely the anchor 152. The opposite end of the torsion spring forms a reaction arm 154 that bears against the mounting plate 112, as best seen in FIGS. 3 and 4. It can be appreciated that the torsion springs on the opposite sides of the apparatus 100 have opposite "handedness" so that both springs cooperate to restrain movement of the corresponding release levers 140.

As explained above, one feature of the present invention is that most of the working components of the folding leg apparatus are contained within the envelope of the mounting plate 110 and mounting flanges 112. Thus, the torsion springs 150 project inwardly into the path of the brace links 122 when the table leg is manipulated into its retracted position. In this position, the torsion springs would interfere with the full rotation of each brace links 122. Consequently, in a further feature of the apparatus 100, each brace link 122 is provided with a cut-out 156 that is positioned to fit over the torsion spring when the link is in its retracted position.

It can be appreciated that the folding leg apparatus of the present invention provides a very compact package that is readily mounted on a variety of tabletops. The placement of the working components ensures that they will not be inadvertently contacted by a person sitting at the table. In other words, there are no "pinch points" that are accessible in ordinary use of the table. The inboard positioning of the actuator plates 142 also ensures that the release levers 140 cannot be inadvertently tripped by a person's leg or foot. On the other hand, the levers are easily accessible when it is desired to fold and store a table. The use of two independent release levers provides a measure of safety against inadvertent release of the locking levers, in contrast to the single lever mechanisms of the prior art. The compact nature of the apparatus 100 allows the individual actuator plates 142 to be positioned a normal hand-span apart so that the levers can be released simultaneously by pressing one plate with the thumb and the other plate with the third finger. This feature frees up the operator's other hand to support the table leg 105 as the locking mechanism is released to avoid an unexpected rotation of the leg.

A further benefit is that the positioning of the locking release levers 140 provides for a more stable or secure latch. In particular, since the levers, and more specifically the locking notches 148, are inboard, they are closer to the leg 105, which reduces the amount of twist that the leg can experience when the upper pivot rod is latched.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

For instance, in the illustrated embodiment, two such apparatuses 100 are configured to be mounted to the underside of a table top, such as of a conference table. A single apparatus 100 may be used on a pedestal table with the leg 105 configured accordingly. Other leg supported articles of furniture may benefit from the features offered by the folding leg apparatus of the present invention.

What is claimed is:

1. A folding leg apparatus for an article of furniture having a top, comprising:

a support leg movable between an extended and a folded position, said leg having a top end adapted to be adjacent said top of the article of furniture in the extended position and a bottom end configured to support the article of furniture on a surface;

a mounting plate configured for attachment to the top of the article of furniture and including a pair of mounting flanges extending along opposite sides of said mounting plate;

an upper pivot rod attached to said support leg adjacent said top end;

a first pivoting connection between each end of said upper pivot rod and a corresponding one of said pair of mounting flanges;

a second pivoting connection between the support leg and a corresponding one of said pair of mounting flanges offset on the support leg from said upper pivot rod: and a latch mechanism including;

a pair of pivot arms, each pivotably mounted to a corresponding one of said pair of mounting flanges and positioned between said flanges, each of said pivot arms including an actuator plate positioned between said flanges and adapted to be manually pressed, each of said pivot arms further defining a locking notch configured to capture said upper pivot rod therein when said support leg is in its extended position and said pivot arms are in a locking position; and a pair of torsion springs, each operatively anchored to a corresponding one of said pivot arms to bias said pivot arms to said locking position and operable to resist rotation of said pivot arms when said corresponding actuator plate is manually pressed, each of said torsion springs positioned between said mounting flanges.

2. The folding leg apparatus according to claim 1, wherein said first pivoting connection includes a pair of swivel brackets, each connected at one end thereof to a corresponding end of said upper pivot rod to pivot relative to the support leg, and pivotably connected at an opposite end thereof to a corresponding one of said pair of mounting flanges.

3. The folding leg apparatus according to claim 2, wherein said pair of swivel brackets are positioned outside said pair of mounting flanges.

4. The folding leg apparatus according to claim 1, wherein said actuator plates define a space between each other sized to receive the support leg therebetween when the leg is in the folded position.

5. The folding leg apparatus according to claim 1, wherein said second pivoting connection includes:

a lower pivot rod attached to the support leg offset from said upper pivot rod; and a pair of brace links, each connected at one end thereof to a corresponding end of said lower pivot rod to pivot relative to the support leg, and pivotably connected at an opposite end thereof to a corresponding one of said pair of mounting flanges.

6. The folding leg apparatus according to claim 5, wherein said pair of brace links are positioned inside said pair of mounting flanges.

7. The folding leg apparatus according to claim 6, wherein said pair of brace links define a cut-out that is configured to provide clearance over a corresponding torsion spring when the support leg is in its folded position.

8. The folding leg apparatus according to claim 1, further comprising a retainer clip attached to one end of said mounting plate, said retainer clip configured to releasably engage the support leg when the leg is its folded position.

9. The folding leg apparatus according to claim 1, wherein said first pivoting connection is pivotably attached to said pair of mounting flanges adjacent one end thereof and said second pivoting connection is pivotably attached to said pair of mounting flanges adjacent an opposite end thereof.

10. The folding leg apparatus according to claim 9, wherein said first pivoting connection defines a pivot arm that is longer than said second pivoting connection.

11. The folding leg apparatus of claim 9, wherein said actuator plates of said pair of pivot arms are disposed adjacent said second pivoting connection.

12. The folding leg apparatus of claim 1, wherein said mounting plate is a one-piece U-shaped plate.

* * * * *